US006481842B2

(12) United States Patent
Beehler et al.

(10) Patent No.: US 6,481,842 B2
(45) Date of Patent: Nov. 19, 2002

(54) HEATING DEVICE AND METHOD FOR USE IN A PRINTING DEVICE

(75) Inventors: James O Beehler, Brush Prairie, WA (US); Geoff Wotton, Battle Ground, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/740,084

(22) Filed: Dec. 18, 2000

(65) Prior Publication Data

US 2002/0075371 A1 Jun. 20, 2002

(51) Int. Cl.[7] ..... B41J 2/01
(52) U.S. Cl. ..... 347/102
(58) Field of Search ..... 347/102, 104

(56) References Cited

U.S. PATENT DOCUMENTS 4,469,026 A * 9/1984 Irwin ..... 101/426
4,774,523 A 9/1988 Beaufort et al.
4,970,528 A 11/1990 Beaufort et al.
5,196,675 A 3/1993 Suzuki et al.
5,287,123 A 2/1994 Medin et al.
5,329,295 A 7/1994 Medin et al.
5,428,384 A 6/1995 Richtsmeier et al.
5,467,119 A 11/1995 Richtsmeier et al.
5,510,822 A 4/1996 Vincent et al.
5,668,584 A 9/1997 Broder et al.
5,774,155 A 6/1998 Medin et al.
5,793,397 A * 8/1998 Barker et al. ..... 347/88
5,864,352 A * 1/1999 Aoki et al. ..... 347/102
5,867,197 A 2/1999 Aoki
5,956,062 A 9/1999 Omata et al.
5,976,673 A 11/1999 Aoki
6,059,406 A 5/2000 Richtsmeier et al.
6,142,619 A * 11/2000 Miura et al. ..... 347/101

* cited by examiner

*Primary Examiner*—John Barlow
*Assistant Examiner*—Ly T Tran

(57) ABSTRACT

Apparatus and methods are disclosed herein for drying printing composition on a print medium. A disclosed apparatus for use in a printing device configured to dispose printing composition on a print medium includes a blower configured to provide an airflow and a heater configured to heat the airflow. The apparatus also includes a duct coupled to the blower and configured to conduct the heated airflow by the print medium to help dry the printing composition on the print medium and a vacuum box coupled to the heated airflow and configured to provide a hold-down force on the print medium adjacent the vacuum box. Further characteristics and features of the present invention are disclosed herein, as are exemplary alternative embodiments. This abstract is not to be used in the interpretation of any of the claims.

4 Claims, 5 Drawing Sheets

FIG. 3
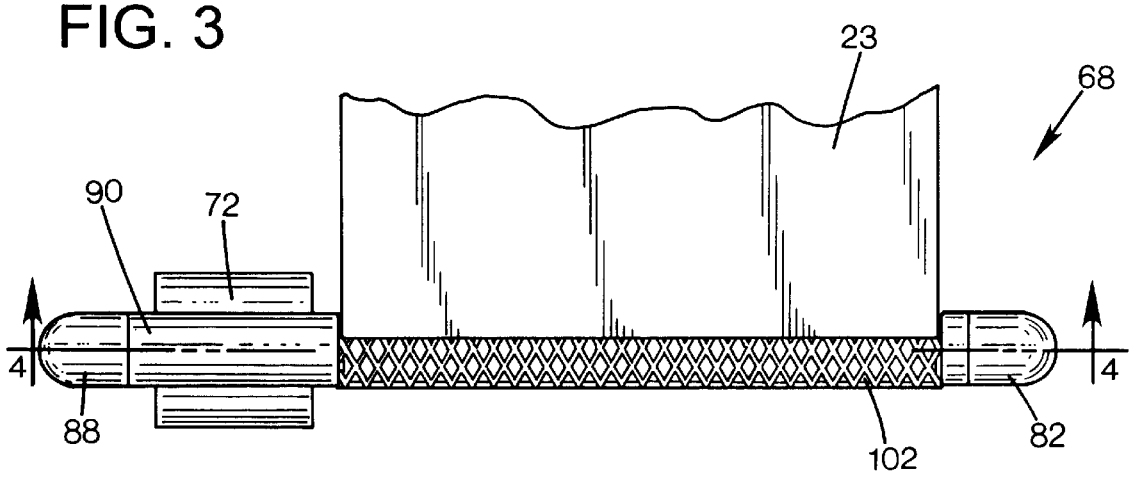
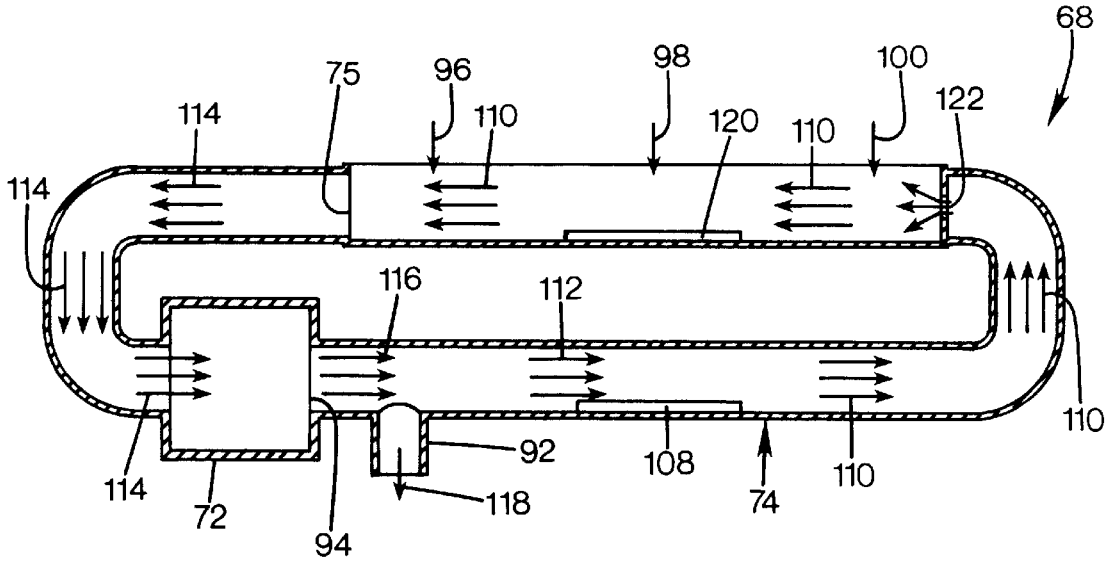
FIG. 4

HEATING DEVICE AND METHOD FOR USE IN A PRINTING DEVICE

BACKGROUND AND SUMMARY

The present invention relates to printing devices. More particularly, the present invention relates to an apparatus and method for drying printing composition on a print medium.

Printing devices, such as inkjet printers and laser printers, use printing composition (e.g., ink or toner) to print images (text, graphics, etc.) onto a print medium in a printzone of the printing device. Inkjet printers may use print cartridges, also known as "pens", which shoot drops of printing composition, referred to generally herein as "ink", onto a print medium such as paper, transparency or cloth. Each pen has a printhead that includes a plurality of nozzles. Each nozzle has an orifice through which the drops are ejected. To print an image, the printhead is propelled back and forth across the page by, for example, a carriage while ejecting drops of ink in a desired pattern as the printhead moves. The particular ink ejection mechanism within the printhead may take on a variety of different forms known to those skilled in the art, such as thermal printhead technology. For thermal printheads, the ink may be a liquid, with dissolved colorants or pigments dispersed in a solvent.

In a current thermal system, a barrier layer containing ink channels and vaporization chambers is located between an orifice plate and a substrate layer. The substrate layer typically contains linear arrays of heating elements, such as resistors, which are energized to heat ink within the vaporization chambers. Upon heating, the ink in the vaporization chamber turns into a gaseous state and forces or ejects an ink drop from a orifice associated with the energized resistor. By selectively energizing the resistors as the printhead moves across the print medium, the ink is expelled in a pattern onto the print medium to form a desired image (e.g., picture, chart or text).

In order for the image to be fixed to the print medium so that it will not smear, the printing composition must be dried. The printing composition is dried by a combination of the solvent evaporating and the solvent absorbing into the print medium, both of which take time. Various factors control the amount of time required for a particular printing composition to dry. These factors include the type of print medium, the quantity of solvent in an printing composition, the amount of printing composition on the print medium, and ambient temperature and humidity. Ideally, the printing composition will be fixed to the print medium quickly to help prevent image smear caused by things such as premature handling, ink puddling and movement before drying which can cause printing defects such as ink coalescence and intercolor bleed, print medium cockle (print medium buckle toward a printhead), and print medium curl (curling along at least one edge of a print medium). Quickly fixing the printing composition to the print medium also helps maximize printing device throughput.

To reduce the amount of this time, the surface of some types of print media may be specially coated to help speed drying. Other means may also be used such as special chemicals, generally know as "fixers", that are applied to print media before or after printing.

Each of these above-described techniques have certain disadvantages. For example, specially coated print media may be relatively more expensive than uncoated print media. Fixers may become depleted during printing, resulting in no fixer being applied for the remainder of a print job, possibly causing some or all of the aforementioned problems, or the stopping of a print job to supply additional fixer, resulting in decreased printing device throughput and possible color hue shift on any print medium for which printing was halted.

Various types of heating devices may also be used to heat print media before and/or after printing. Pressure may also be applied, alone or in combination with heat from a heating device, to help reduce this amount of time.

For example, at least some radiant heating devices have been used to apply infrared heat energy to the back side of print media in the print zone. Such radiant heaters may use a heat source that is hot enough to damage or ignite the print media. One way in which ignition was avoided involved limiting the amount of time the print media is exposed to the heat source. However, if there is a failure in the printing device which causes the print media to dwell too long (e.g., a print media jam or printing device power failure), then the print media is in danger of being burned. Another way in which ignition was avoided involved lowering the power delivered to the radiant heater, thereby reducing the amount of radiant heat energy delivered to the print media. However, at least one problem with this approach was that the amount of radiant heat energy delivered to the print media was reduced significantly which lowered the overall efficacy of the radiant heating device in fixing printing composition on print media.

As another example, conductive heating may be used in a printing device by using a vacuum to hold down print media against a heated surface. A potential disadvantage of such designs is that if the vacuum hold-down force is not quite strong enough to counter the tendency of the print media to cockle, then contact with the heater will be lost at those cockle locations. Once contact is lost, the heat transfer to the cockle-affected regions is reduced and the tendency to cockle will increase. Relatively higher levels of vacuum are needed to avoid this problem, thus adding to the cost of the printing device and making it more difficult to move the print media against this higher vacuum hold-down force.

Pressure generating devices, such as pressure rollers, can cause image smear. Also, pressure generating devices add to the overall cost, size and complexity of the printing device.

An apparatus and method that decreased the amount of time required to dry or fix printing composition to a print medium while avoiding the above-described problems associated with other techniques would be a welcome improvement. Accordingly, the present invention is directed to drying printing composition on a print medium quickly to help prevent image smear, ink coalescence, intercolor bleed, print media cockle, and print media curl. The present invention is also directed to helping maximize printing device throughput. The present invention is additionally directed to eliminating the need for specially coated media and fixers to accelerate drying.

Accordingly, an embodiment of an apparatus in accordance with the present invention for use in a printing device configured to dispose printing composition on a print medium includes a blower configured to provide an airflow. The apparatus also includes a heater configured to heat the airflow and a duct coupled to the blower and configured to conduct the heated airflow by the print medium to help dry the printing composition on the print medium. The apparatus further includes a vacuum box coupled to the heated airflow and configured to conduct the heated airflow under the print medium and further configured to provide a hold-down force on the print medium adjacent the vacuum box.

The above-described embodiment of an apparatus in accordance with the present invention may be modified and include at least the following characteristics, as described below. The heater may be positioned in the vacuum box. The apparatus may additionally include a vent coupled to the duct to exhaust a portion of the airflow from the duct during conduction through the duct.

The vacuum box may also include a grill coupled to the airflow and positioned to conduct the heated airflow under the print media and a restrictor configured to impede the airflow prior to conduction under the print medium so that a pressure under the print medium is less than an ambient pressure above the print medium, thereby providing a vacuum hold-down force on the print medium adjacent the grill. In such cases, the heater may be positioned beneath the grill.

An alternative embodiment of an apparatus in accordance with the present invention for use in a printing device configured to dispose printing composition on a print medium includes structure for providing an airflow. The apparatus also includes structure for convectively heating the print medium by conducting a heated airflow by the print medium to help dry the printing composition on the print medium. The apparatus further includes structure for providing a vacuum hold-down force on the print medium.

The above-described alternative embodiment of an apparatus in accordance with the present invention may be modified and include at least the following characteristics, as described below. The apparatus may additionally include structure for radiatively heating the print medium to help dry the printing composition on the print medium. The apparatus may also include structure for exhausting a portion of the airflow from the structure for convectively heating the print medium by conducting a heated airflow by the print medium to help dry the printing composition on the print medium.

Yet another alternative embodiment of an apparatus in accordance with the present invention for use in a printing device configured to dispose printing composition on a print medium includes a vacuum unit configured to generate an airflow and direct the airflow by the print medium to create a hold-down force on the print medium adjacent the vacuum unit. The apparatus also includes a plurality of heaters each of which is disposed in the airflow to convectively heat the airflow to help dry the printing composition on the print medium.

The above-described additional alternative embodiment of an apparatus in accordance with the present invention may be modified and include at least the following characteristics, as described below. At least one of the heaters may be disposed in the vacuum unit to radiate heat toward the print medium to further help dry the printing composition on the print medium. The vacuum unit may include a blower configured to provide an airflow and a duct coupled to the blower and configured to conduct the airflow by the print medium. The apparatus may also include a vent coupled to the duct to exhaust a portion of the airflow from the duct during conduction through the duct.

An embodiment of a method in accordance with the present invention for use in a printing device configured to dispose printing composition on a print medium includes generating an airflow. The method also includes heating the airflow and conducting the heated airflow by the print medium to help dry the printing composition on the print medium. The method further includes restricting the airflow to create a vacuum hold-down force on the print medium.

The above-described embodiment of a method in accordance with the present invention may be modified and include at least the following characteristics, as described below. The method may additionally include exhausting a portion of the airflow.

An alternative embodiment of a method in accordance with the present invention for use in a printing device configured to dispose printing composition on a print medium includes generating an airflow. The method additionally includes heating the airflow and convectively heating the print medium through movement of the heated airflow by the print medium to help dry the printing composition on the print medium. The method further includes restricting the airflow to create a vacuum hold-down force on the print medium.

The above-described alternative embodiment of a method in accordance with the present invention may be modified and include at least the following characteristics, as described below. The method may also include radiatively heating the print medium to further help dry the printing composition on the print medium.

The foregoing summary is not intended by the inventors to be an inclusive list of all the aspects, advantages, and features of the present invention, nor should any limitation on the scope of the invention be implied therefrom. This summary is provided in accordance with 37 C.F.R. Section 1.73 and M.P.E.P. Section 608.01(d). Additionally, it should be noted that the use of the word substantially in this document is used to account for things such as engineering and manufacturing tolerances, as well as variations not affecting performance of the present invention. Other objects, advantages, and novel features of the present invention will become apparent from the following detailed description when considered in conjunction with the accompanying drawings.

BRIEF DESCRIPTION OF THE DRAWINGS

FIG. 3 is a top view of the heating device shown in FIG. 2.

FIG. 4 is a sectional view of the heating device shown in FIG. 3 taken along line 4—4 of FIG. 3.

DETAILED DESCRIPTION OF THE DRAWINGS

Figure 1:
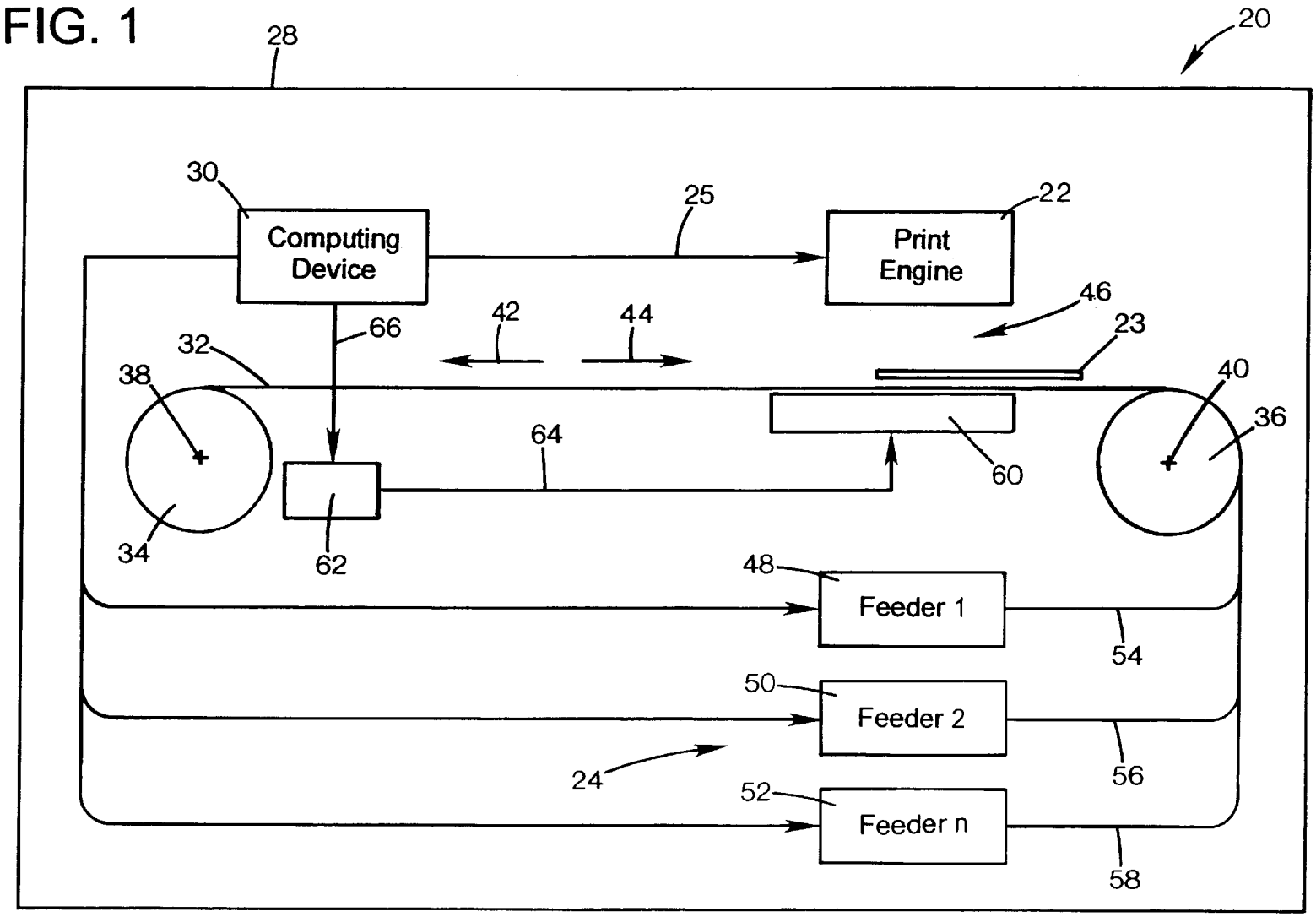
FIG. 1 is a diagrammatic view of a printing device that includes an embodiment of the present invention.

FIG. 1 is a diagrammatic view of a printing device 20 that includes an embodiment of the present invention and which may be used for printing business reports, correspondence, desktop publishing, and the like. A variety of printing devices are commercially available. For instance, some of the printing devices that may embody the present invention include printers, plotters, copiers, and facsimile machines, to name a few, as well as various combination devices, such as combination facsimiles and printers. In addition, the present invention may be used in a variety of types of printing devices such as inkjet printers and laser printers.

Some of the major elements of printing device 20 are shown in FIG. 1, including print engine 22, print media handling system 24, and housing or casing 28. Print engine 22 may comprise any type of apparatus by which an image is recorded on print medium 23, including inkjet printing mechanisms and laser mechanisms. A computing device 30 is used to control formation of images on print medium 23 by print engine 22, as generally indicated by arrow 25. Computing device 30 may receive instructions from a host device, typically a computer, such as a personal computer (not shown). Many of the functions of computing device 30 may be performed by a host computer (not shown), including any printing device 20 drivers resident on the host computer, by electronics in printing device 20, or by interactions between the host computer and the electronics. As used herein, the term "computing device 30" encompass these functions, whether performed by a host device, printing device 20, an intermediary device between the host device and printing device 20, or by combined interaction of such elements.

Print media handling system 24 also includes a printing surface 32 and a pair of driven roller mechanisms 34 and 36, each of which is diagrammatically illustrated by a single roller in FIG. 1. Roller mechanisms 34 and 36 may be selectively driven by computing device 30 of printing device 20 and one or more motors and drive gears (which are not shown) so as to rotate about points 38 and 40 in either a clockwise or counter-clockwise direction to selectively move print medium 23 in either of the directions indicated by arrows 42 and 44 through printzone 46 and along printing surface 32. Roller mechanisms 34 and 36 each include any necessary pinch rollers, star wheels, idler rollers, nips, belts, etc. to convey print medium 23, as described above.

As can also be seen in FIG. 1, print media handing system 24 includes a plurality of print media feeders 48, 50, and 52. Feeders 48, 50, and 52 each include a tray for sheets of print media or a rack for a roll of print media, as well as the necessary components to transport print media to printzone 46 of printing device 20 for printing by print engine 22 via print media feed paths 54, 56, and 58. Feeders 48, 50, and 52 may each be separately configured to hold various sized print media or, alternatively, fixed sized print media. Computing device 30 of printing device 20 is also coupled to each of feeders 48, 50, and 52 to control selective transport of print media from any one of feeders 48,50, and 52 to printzone 46 for printing of images by print engine 22. The present invention may be used with printing devices having any number of print media input trays and/or racks which is noted in FIG. 1 through the use of the designation "Feeder n" for feeder 52.

As can additionally be seen in FIG. 1, printing device 20 includes a heating device 60, in accordance with the present invention, positioned as shown so as to apply heat energy to print medium 23 to heat any printing composition on print medium 23, as more fully discussed below. Heating device 60 receives energy from power source 62, as generally indicated by arrow 64 in FIG. 1. Power source 62 is controlled by computing device 30 to supply energy to heating device 60, as generally indicated by arrow 66 in FIG. 1.

Figure 2:
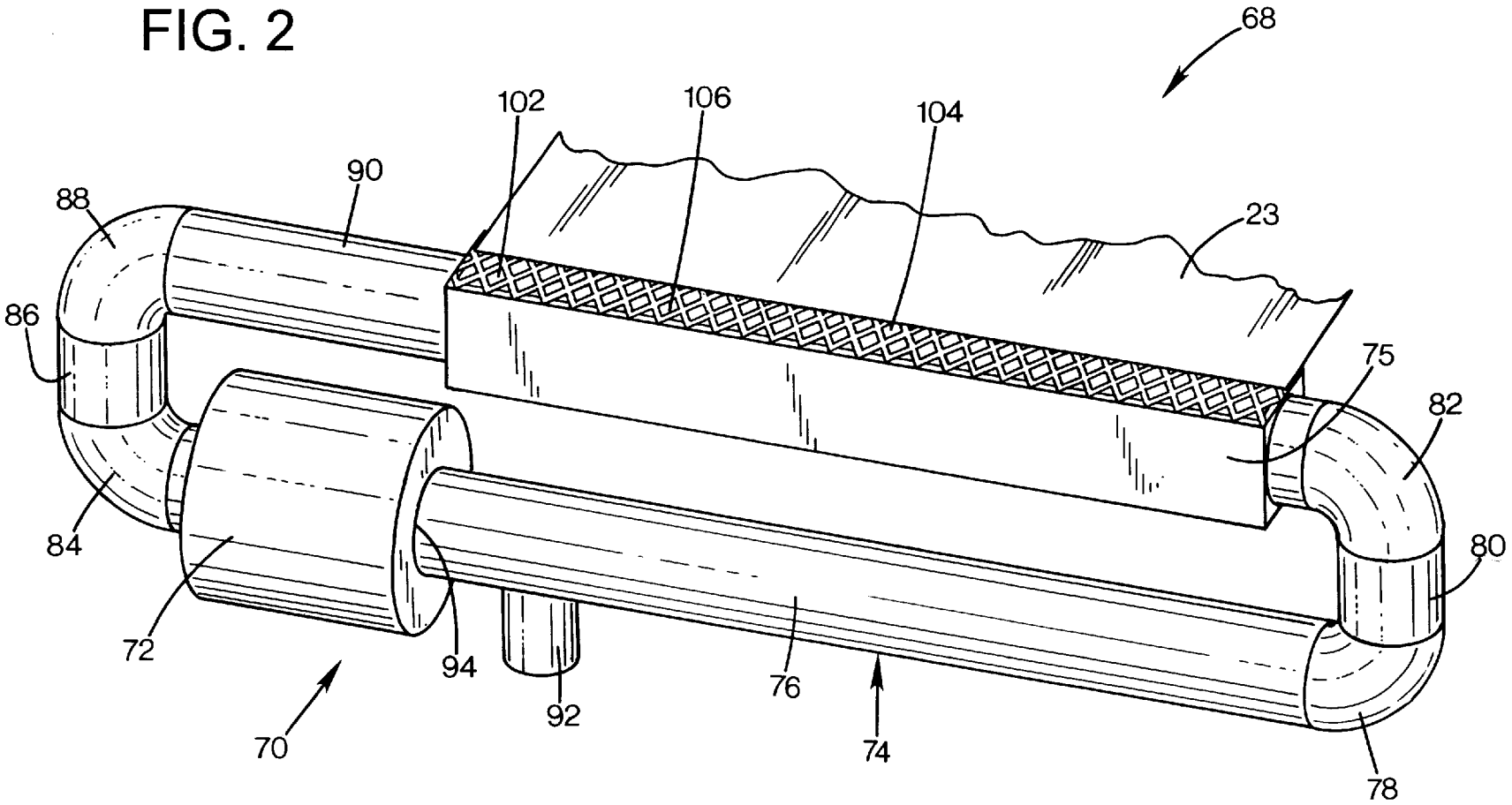
FIG. 2 is a perspective view of an embodiment of a heating device in accordance with the present invention.

A perspective view of an embodiment of a heating device 68 in accordance with the present invention is shown in FIG. 2. A top view of heating device 68 is shown in FIG. 3. Heating device 68 includes a vacuum unit 70 configured to generate an airflow by print medium 23 to create a hold-down force on print medium 23 adjacent vacuum unit 70, as more fully discussed below in connection with FIG. 4. Vacuum unit 70 includes a blower 72 configured to provide and airflow and a duct 74 coupled to blower 72 and configured to conduct a heated airflow by print medium 23 to help dry print composition on print medium, as also more fully discussed below in connection with FIG. 4.

Referring again to FIGS. 2 and 3, heating device 68 also includes a vacuum box 75 coupled to the heated airflow and configured to both conduct the heated airflow under print medium 23 and provide the hold-down force on print medium 23 adjacent vacuum box 75. As can be seen in FIG. 2, duct 74 also includes a plurality of interconnected pipes 76, 78, 80, 82, 84, 86, 88, and 90 coupled to blower 72 and vacuum box 75.

Heating device 68 also includes a vent 92 coupled pipe 76 of duct 74 to exhaust a portion of the airflow from duct 74 during conduction of the airflow therethrough. Vent 92 is positioned on exhaust side 94 of blower 72 and is provided because of the unavoidable leak of air through and around the edges of print medium 23, illustrated diagrammatically in FIG. 4 via arrows 96, 98, and 100. Referring again to FIGS. 2 and 3, heating device 68 also includes a grill 102 coupled to the heated airflow and configured to conduct the heated airflow under print medium 23. As can be seen in FIGS. 2 and 3, grill 102 is formed to include a plurality of openings, such as openings 104 and 106, that facilitate both convection and radiation of heat energy to print medium 23 to help dry the printing composition thereon, as discussed more fully below.

A sectional view of heating device 68 taken along line 4—4 of FIG. 3 is shown in FIG. 4. As can be seen in FIG. 4, heating device 68 includes convective heater 108 positioned in duct 74 as shown. Convective heater 108 is controlled by computing device 30 and receives power to operate from power source 62. In accordance with the present invention, convective heater 108 convectively heats print medium 23 by movement of heated airflow 110 by print medium 23. Heating print medium 23 by convection helps dry the printing composition thereon. Heated airflow 110 is generated by heating airflow 112 from exhaust side 94 of blower 72 by convection as it passes over convective heater 108. After heated airflow 110 passes by print medium 23 it is returned to blower 72 for reheating by convective heater 108, as generally indicated by groups of arrows 114 in FIG. 4. As can be seen in FIG. 4, a portion 118 of airflow 116 from blower 72 is exhausted from duct 74 during conduction of the airflow therethrough via above-described vent 92.

Although not shown, it is to be understood that, in accordance with the present invention, airflow portion 118 may be directed toward print medium 23 subsequent to printing in printzone 46 to further help dry printing composition on print medium 23. In addition or alternatively, although not shown, it is to be understood that, in accordance with the present invention, airflow portion 118 may be directed toward one or more of print media feeders 48, 50, and 52 to precondition print media before printing in printzone 46 by helping remove moisture from such print media.

Heating of print medium 23 by convection in accordance with the present invention, as described above, has several advantages including that it is easy to control the temperature of heated airflow 110 thereby helping avoid damage to or ignition of print medium 23 caused by overheating. Also, because heat energy is transferred to print medium 23 by heated airflow 110, if print medium 23 is slightly cockled, the rate of heat transfer will not change and print medium 23 cockle will not increase, as can occur with conductive heating devices due to loss of physical contact with the conductive heater. Additionally, because cockled regions of print medium 23 are heated as well as non-cockled regions, printing composition on any such cockled regions dries at the same rate as on non-cockled regions so that the resultant dried image on the entire surface of print medium 23 looks more substantially uniform across both the cockled and non-cockled regions.

As can also be seen in FIG. 4, heating device 68 includes an additional heater 120 positioned in vacuum box 75 as shown. Heater 120 is also controlled by computing device 30 and receives power to operate from power source 62. Heater 120 heats print medium 23 by both convection and radiation. Convection heating occurs through movement of airflow 110 across heater 120 as shown in FIG. 4. Radiative heating occurs as print medium 23 moves across grill 102.

In accordance with the present invention, the use of two heaters 108 and 120 in heating device 68 provides a substantially uniform temperature profile across print medium 23 adjacent grill 102. Use of only one heater, for example heater 120, can result in a temperature gradient across print medium 23 adjacent grill 102. Such a temperature gradient will cause printing composition on one side of print medium 23 to dry at a different rate than printing composition on the other side of print medium 23, resulting in output print quality defects such as print medium cockle and curl.

As can be seen in FIG. 4, heating device 68 also includes a restrictor 122 configured to impede airflow 110 prior to conduction under print medium 23 so that a pressure under print medium 23 is less than an ambient pressure above print medium 23. This lower pressure under print medium 23 provides a vacuum hold-down force on print medium 23 adjacent grill 102. The use of a vacuum hold down on print medium 23 helps provide a substantially uniform flat surface across print medium 23 adjacent grill 102 which reduces cockle formation during printing, allows for reduced print engine 22 to print medium 23 spacing which improves printing device 20 output print quality, and helps prevent contact between print engine 22 and print medium 23 which decreases printing device 20 output print quality and can damage print engine 22 and print medium 23.

Figure 5:
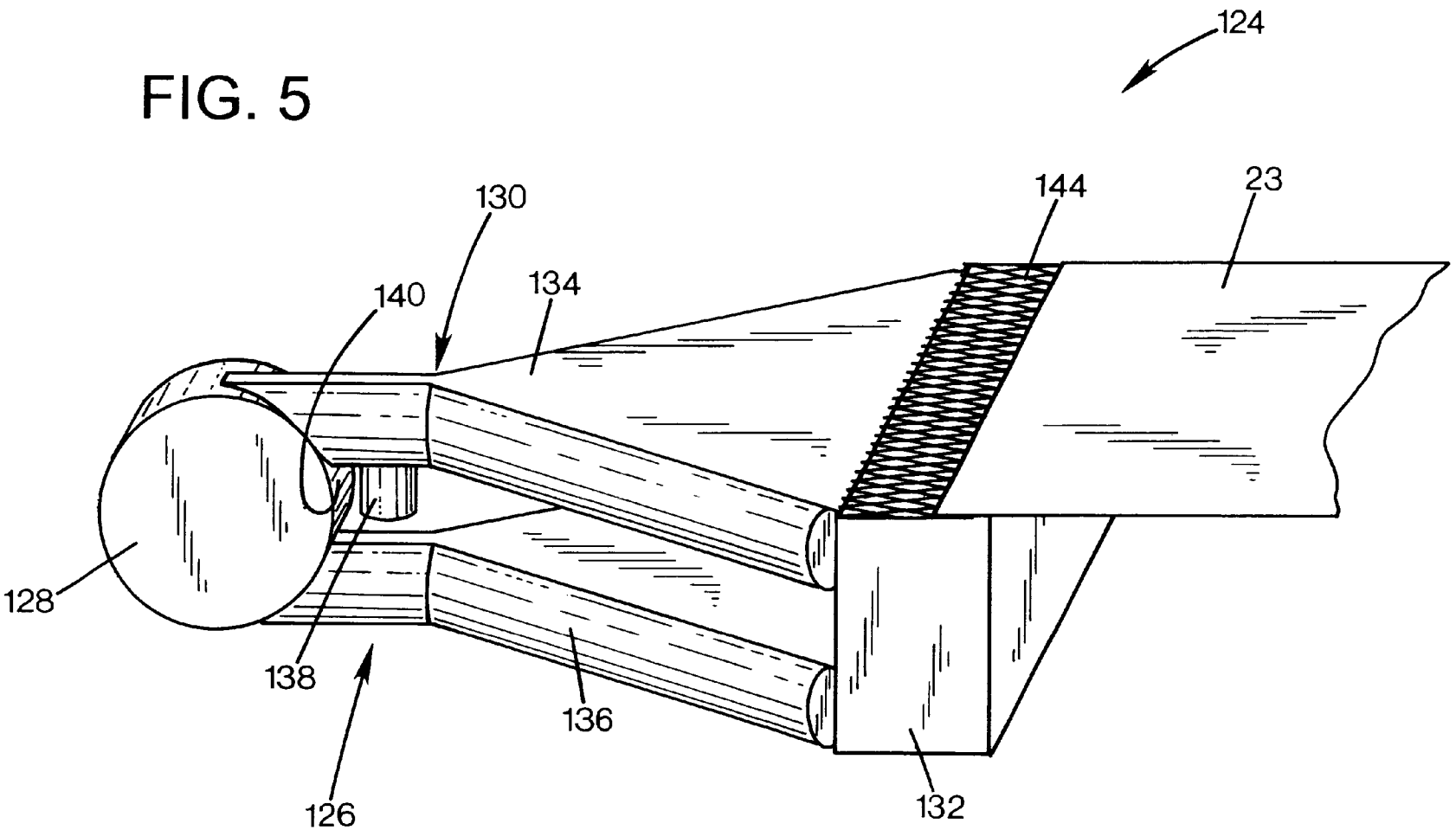
FIG. 5 is a perspective view of an alternative embodiment of a heating device in accordance with the present invention.
Figure 6:
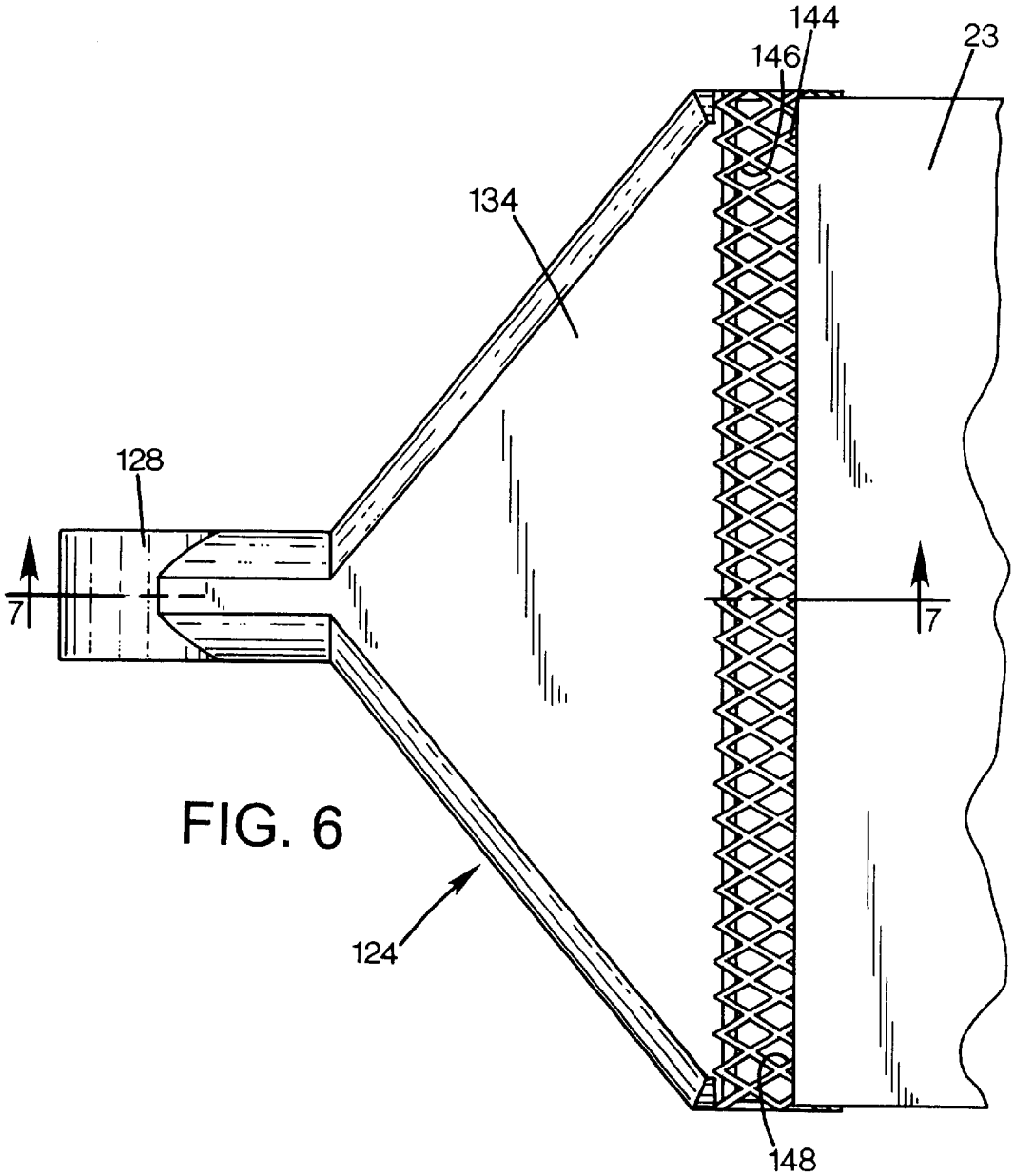
FIG. 6 is a top view of the heating device shown in FIG. 5.

A perspective view of an alternative embodiment of a heating device 124 in accordance with the present invention is shown in FIG. 5. A top view of heating device 124 is shown in FIG. 6. Heating device 124 includes a vacuum unit 126 configured to generate an airflow by print medium 23 to create a hold-down force on print medium 23 adjacent vacuum unit 128, as more fully discussed below in connection with FIG. 7. Vacuum unit 126 includes a blower 128 configured to provide an airflow and a duct 130 coupled to blower 128 and configured to conduct a heated airflow by print medium 23 to help dry print composition on print medium, as also more fully discussed below in connection with FIG. 7.

Referring again to FIGS. 5 and 6, heating device 124 also includes a vacuum box 132 coupled to the heated airflow and configured to both conduct the heated airflow under print medium 23 and provide the hold-down force on print medium 23 adjacent vacuum box 132. As can be seen in FIG. 5, duct 130 also includes a plurality of manifolds 134 and 136 each of which is coupled to blower 128 and vacuum box 132.

Heating device 124 also includes a vent 138 coupled to manifold 134 of duct 130 to exhaust a portion of the airflow from duct 130 during conduction of the airflow therethrough. Vent 138 is positioned on exhaust side 140 of blower 128 and is provided because of the unavoidable leak of air through and around the edges of print medium 23, illustrated diagrammatically in FIG. 7 via arrow 142. Referring again to FIGS. 5 and 6, heating device 124 also includes a grill 144 coupled to the heated airflow and configured to conduct the heated airflow under print medium 23. As can be seen in FIGS. 5 and 6, grill 144 is formed to include a plurality of openings, such as openings 146 and 148, that facilitate both convection and radiation of heat energy to print medium 23 to help dry the printing composition thereon, as discussed more fully below.

Figure 7:
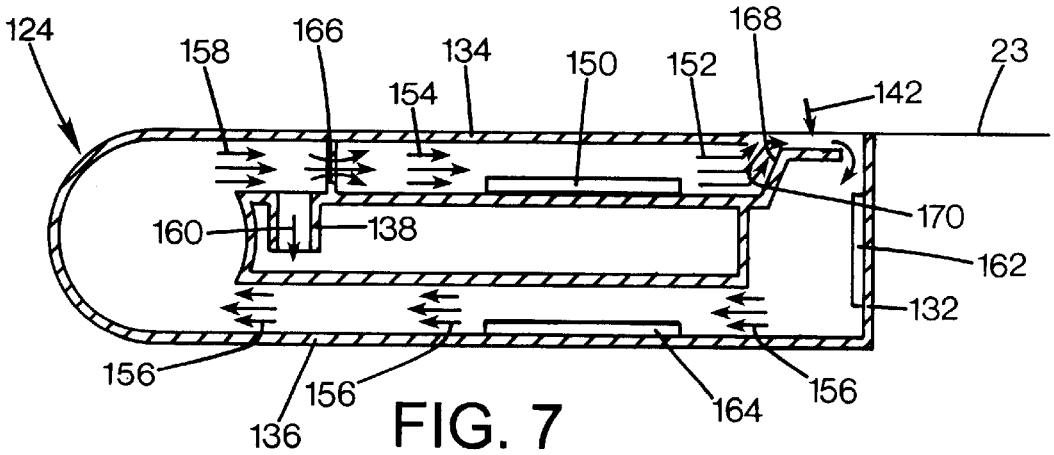
FIG. 7 is a sectional view of the heating device shown in FIG. 6 taken along line 7—7 in FIG. 6.

A sectional view of heating device 124 taken along line 7—7 of FIG. 6 is shown in FIG. 6. As can be seen in FIG. 7, heating device 124 includes convective heater 150 positioned in manifold 134 as shown. Convective heater 150 is controlled by computing device 30 and receives power to operate from power source 62. In accordance with the present invention, convective heater 150 convectively heats print medium 23 by movement of heated airflow 152 by print medium 23. Heating print medium 23 by convection helps dry the printing composition thereon. Heated airflow 152 is generated by heating airflow 154 from exhaust side 140 of blower 128 by convection as it passes over convective heater 150. After heated airflow 152 passes by print medium 23 it is returned to blower 128 for reheating by convective heater 150, as generally indicated by groups of arrows 156 in FIG. 7. As can be seen in FIG. 7, a portion 160 of airflow 158 from blower 128 is exhausted from duct 130 during conduction of the airflow therethrough via above-described vent 138.

Although not shown, it is to be understood that, in accordance with the present invention, airflow portion 160 may be directed toward print medium 23 subsequent to printing in printzone 46 to further help dry printing composition on print medium 23. In addition or alternatively, although not shown, it is to be understood that, in accordance with the present invention, airflow portion 160 may be directed toward one or more of print media feeders 48, 50, and 52 to precondition print media before printing in printzone 46 by helping remove moisture from such print media.

As can also be seen in FIG. 7, heating device 124 includes an additional heater 162 positioned in vacuum box 132 and additional heater 164 positioned in manifold 136 as shown. Heaters 162 and 164 are also controlled by computing device 30 and receive power to operate from power source 62. Heater 162 heats print medium 23 by convection. Convection heating occurs through movement of airflow 152 across heater 162 as shown in FIG. 7. Heater 164 helps heat print medium 23 by convection. Convection heating occurs through movement of airflow 156 across heater 164 as shown in FIG. 7.

In accordance with the present invention, the use of heaters 150, 162, and 164 in heating device 124 provides a substantially uniform temperature profile across print medium 23 adjacent grill 144. Use of only one heater, for example heater 150, can result in a temperature gradient across print medium 23 adjacent grill 144. Such a temperature gradient will cause printing composition on one side of print medium 23 to dry at a different rate than printing composition on the other side of print medium 23, resulting in output print quality defects such as print medium cockle and curl.

As can be seen in FIG. 7, heating device 124 also includes a restrictor 166 configured to impede airflow 158 prior to conduction under print medium 23 so that a pressure under print medium 23 is less than an ambient pressure above print medium 23. This lower pressure under print medium 23 provides a vacuum hold-down force on print medium 23 adjacent grill 144. The use of a vacuum hold down on print medium 23 helps provide a substantially uniform flat surface across print medium 23 adjacent grill 144 which reduces cockle formation during printing, allows for reduced print engine 22 to print medium 23 spacing which improves printing device 20 output print quality, and helps prevent contact between print engine 22 and print medium 23 which decreases printing device 20 output print quality and can damage print engine 22 and print medium 23.

An additional restrictor 168 configured to impede airflow 152 prior to conduction under print medium 23 is also shown in FIG. 7. Restrictor 168 is formed in manifold 134 by reducing the cross-sectional area 170 thereof, as shown in FIG. 7.

Although the invention has been described and illustrated in detail, it is to be clearly understood that the same is intended by way of illustration and example only, and is not to be taken necessarily, unless otherwise stated, as an express limitation, nor is it intended to be exhaustive or to limit the invention to the precise form or to the exemplary embodiments disclosed. Modifications and variations may well be apparent to those skilled in the art. Similarly, any method elements described may be interchangeable with other method elements in order to achieve the same result.

For example, in alternative embodiments of the present invention, interconnected pipes 76, 78, 80, 82, 84, 86, 88, and 90 may be replaced with two pipes formed in the needed shapes to couple blower 72 and vacuum box 75 together. As another example, although restrictor 122 is a separate structure from duct 74, in one or more alternative embodiments of the present invention, an equivalent restrictor like restrictor 168 may be provided by reducing the cross-sectional area of duct 74 between blower 72 and vacuum box 75. As an additional example, in one or more alternative embodiments of the present invention, only one convective heater may be used. As a further example, in one or more other embodiments of the present invention, the heated airflow may be alternatively or additionally directed above print media to convectively heat the print media to help dry printing composition thereon. The spirit and scope of the present invention are to be limited only by the terms of the following claims.

Reference to an element in the singular is not intended to mean "one and only one" unless explicitly so stated, but rather means "one or more." Moreover, no element or component in the present specification is intended to be dedicated to the public regardless of whether the element or component is explicitly recited in the following claims. Finally, no claim element herein is to be construed under the provisions of 35 U.S.C. Section 112, sixth paragraph, unless the element is expressly recited using the phrase "means for . . . "

What is claimed is:

1. An apparatus for use in a printing device configured to dispose printing composition on a print medium, the apparatus comprising:

a blower configured to provide an airflow;

a heater configured to heat the airflow;

a duct coupled to the blower and configured to conduct the heated airflow by the print medium to help dry the printing composition on the print medium;

a vacuum box coupled to the heated airflow and configured to provide a hold-down force on the print medium adjacent the vacuum box, wherein the vacuum box includes: a grill coupled to the airflow and positioned to conduct the heated airflow under the print media; and a restrictor configured to impede the airflow prior to conduction under the print medium so that a pressure under the print medium is less than an ambient pressure above the print medium, thereby providing a vacuum hold-down force on the print medium adjacent the grill.

2. The apparatus of claim 1 wherein the heater is positioned in the vacuum box.

3. The apparatus of claim 1 further comprising a vent coupled to the duct to exhaust a portion of the airflow from the duct during conduction through the duct.

4. The apparatus of claim 1, wherein the heater is positioned beneath the grill.

* * * * *